United States Patent [19]

Benz et al.

[11] Patent Number: 4,738,078

[45] Date of Patent: Apr. 19, 1988

[54] METHOD OF, AND APPARATUS FOR, WRAPPING OBJECTS, ESPECIALLY QUADRANGULAR BLOCK-LIKE OBJECTS WITH A WEB-LIKE WRAPPING MATERIAL

[75] Inventors: Gottlieb Benz, Flums; Hans-Ulrich Stauber, Grüt, both of Switzerland

[73] Assignee: Ferag AG, Hinwil, Switzerland

[21] Appl. No.: 905,973

[22] Filed: Sep. 11, 1986

Related U.S. Application Data

[63] Continuation of Ser. No. 592,000, Mar. 21, 1984, abandoned.

[30] Foreign Application Priority Data

Mar. 22, 1983 [CH] Switzerland ..... 1543/83

[51] Int. Cl.[4] ..... B65B 63/02

[52] U.S. Cl. ..... 53/439; 53/466; 53/528; 53/530; 53/228

[58] Field of Search ..... 53/218, 228, 229, 580, 53/582, 589, 436, 439, 526, 220, 230, 231, 528, 530, 466, 586

[56] References Cited

U.S. PATENT DOCUMENTS

| | | | |
|---|---|---|---|
| 2,700,459 | 1/1955 | Anspacher | 53/528 X |
| 2,741,885 | 4/1956 | Allison | 53/526 X |
| 3,224,161 | 12/1965 | Conti | 53/586 X |
| 3,511,014 | 5/1970 | Kochalski | 53/436 |
| 3,729,886 | 5/1973 | Lucas et al. | 53/439 X |
| 4,377,061 | 3/1983 | Olson et al. | 53/436 X |

FOREIGN PATENT DOCUMENTS

| | | | |
|---|---|---|---|
| 516215 | 10/1977 | Australia . | |
| 23488 | 2/1977 | Japan | 53/528 |
| 33793 | 3/1977 | Japan | 53/528 |
| 424065 | 6/1982 | Sweden . | |
| 1417082 | 12/1975 | United Kingdom . | |

*Primary Examiner*—Robert L. Spruill
*Assistant Examiner*—Steven P. Weihrouch
*Attorney, Agent, or Firm*—Werner W. Kleeman

[57] ABSTRACT

The package to be wrapped is moved during a first step towards a foil section which is extended under tension transversely relative to the direction of movement of the package. During a further course of movement of the package the aforementioned foil section is applied to three sides around the package in a substantially U-shape. Subsequently, a loop is formed from the web-like foil by entraining means which act on the web-like foil. The two runs of the loop are releasably held at their ends by related holding means. These two loop runs of the foil are separated from each other using a cutting knife. The foil section thus produced, which runs along the rear side of the package, has a length which is greater than the height of the package. An end section of this foil section of greater length and which protrudes past the package is now displaced towards and against the underside of the package. A wrapping material preferably consisting of a polyvinylidene chloride foil having self-adhesive properties is used as the web-like foil.

45 Claims, 8 Drawing Sheets

METHOD OF, AND APPARATUS FOR, WRAPPING OBJECTS, ESPECIALLY QUADRANGULAR BLOCK-LIKE OBJECTS WITH A WEB-LIKE WRAPPING MATERIAL

CROSS-REFERENCE TO RELATED APPLICATION

This application is a continuation application of our commonly assigned, copending U.S. application Ser. No. 06/592,000, filed Mar. 21, 1984, entitled "APPARATUS FOR WRAPPING OBJECTS, ESPECIALLY QUADRANGULAR BLOCK-LIKE OBJECTS WITH A WEB-LIKE WRAPPING MATERIAL", now abandoned.

BACKGROUND OF THE INVENTION

The present invention relates to a new and improved method of, and apparatus for, wrapping compressible objects, especially substantially quadrangular, block-like objects, particularly packages formed by stacked, substantially flat products, for example, printed products, in a substantially web-like wrapping material.

While the description to follow, as a matter of convenience, refers to the wrapping of printed products, obviously other types of products can be conveniently handled, and therefore, the use of this term is not to be construed in a limiting sense in any way whatsoever, merely is to be viewed as an exemplary and desirable field of application for the inventive measures.

In its more particular aspects, the present invention relates specifically to a new and improved method of wrapping compressible objects, especially substantially quadrangular, block-like objects, particularly packages, formed by stacked, flat products, for example, printed products, in a web-like wrapping material or web-like foil. During a first step of such method the object to be wrapped is moved against a web or web-like foil of wrapping material which is held so as to extend transversely to the path of movement of the object. During the course of further movement of the object, the web of wrapping material is applied around the object in a substantially U-shape. During a subsequent second step of the method the web of wrapping material is withdrawn from a storage roll and guided along a rear side of the object as seen in its direction of movement.

In known wrapping machines operating according to a method of such kind, there are arranged related storage rolls holding a weldable foil above and below the path of movement of the object to be wrapped. The ends of the two foils are welded to each other so that a foil curtain is formed which extends transversely to the path of movement of the object. The object is moved towards the foil curtain and during its further course of movement entrains the foil which thus is applied to three sides of the object in a U-shape. The two foil sections which run along the top side and the bottom side of the object, respectively, are brought together on the rear side of the object while the two storage rolls are unwound and are interconnected by a severing welding action in which the two foils are welded to each other to again form a new foil curtain at the same time. The two foil sections which are to be welded to each other on the rear side of the object may not be subject to an appreciable tension during the severing and welding operation. Therefore, the wrapping or enclosure thus formed extends only relatively loosely around the object. For this reason, the enclosed object is subsequently passed through a heat tunnel in which the foil is subject to shrinkage and afterwards narrowly or tightly encloses the object.

Such apparatus has the disadvantage of a considerable structural expense and requires the use of relatively thick and weldable foils.

SUMMARY OF THE INVENTION

Therefore, with the foregoing in mind, it is a primary object of the present invention to provide a new and improved method of, and apparatus for, wrapping compressible objects especially substantially quadrangular, block-like objects, particularly packages formed by stacked substantially flat products, for example, printed products, in a substantially web-like wrapping material or web-like foil in a manner which is not afflicted with the aforementioned drawbacks and limitations of the prior art heretofore discussed.

Another and more specific object of the present invention is directed to the provision of a new and improved method of, and apparatus for wrapping objects, especially substantially quadrangular, block-like objects, particularly packages formed by stacked substantially flat products, for example, printed products, in a substantially web-like wrapping material which enables the object to be wrapped in a manner which is as simple as possible and operates as rapidly as possible at the smallest possible expense.

Now in order to implement these and further objects of the invention, which will become more readily apparent as the description proceeds, the method of the present development is manifested by the features that, the web-like wrapping material is withdrawn from a single storage roll and is held in the region of its free end so as to extend under tension transversely relative to a predetermined conveying path of the object. The free end of the web of material is released during the further movement of the object during a first step of the wrapping operation. During a second step of the wrapping operation a section of the web-like material is guided along the rear side of the object and simultaneously a new section of the web material is extended under tension transversely to the predetermined conveying path of the object and the free end of the new section is releasably retained. The section of the web material which is guided along the rear side of the object is of a greater length than the dimension of the object in the longitudinal direction of this section of the web material. During a third step of the wrapping operation the end section of the last-mentioned section of the web material which protrudes past the object is displaced towards and against the same.

As alluded to above, the invention is not only concerned with the aforementioned method aspects, but also relates to a novel construction of apparatus for the performance thereof. Generally speaking, the inventive apparatus comprises conveying means for conveying the object to be wrapped along a predetermined conveying path, means to hold the substantially web-like wrapping material in a direction extending transversely relative to the predetermined conveying path of the object, and means for withdrawing the web material from a storage roll and guiding the web material along the rear side of the object as seen in the conveying direction thereof, after the web material has been placed around the object in a substantially U-shaped configuration.

To achieve the aforementioned measures and objects the inventive apparatus for wrapping objects, especially substantially quadrangular, block-like objects, particularly packages formed by substantially flat products, for example, printed products, in a substantially web-like wrapping material, in its more specific aspects, comprises:

a holding arrangement on one side of the predetermined conveying path of the object for releasably holding the free end of the web-like material which is connected to a single storage roll arranged on the other side of the predetermined conveying path;

the means for withdrawing the web-like material from the storage roll and for guiding the web-like material along the rear side of the object simultaneously (i) extends under tension a first section of the web material transversely to the predetermined conveying path of the object, which section of web material is releasably held by the holding arrangement in the region of its end, and (ii) forms a second section of web material running along the rear side of the object and having a length which is greater than the dimension of the object in the longitudinal direction of this second section of web material; and further means to displace towards and against the object the end section of such second section of web material which protrudes past the object.

The use of only a single web of material and displacing or folding the section of material which is located on the rear side of the object and protrudes past the same, preferably towards and against a bearing surface thereof, permits tightly enclosing the object by the wrapping material without welding the same. Due to the elimination of the severing and welding step there can be dispensed with not only the corresponding welding apparatus, but also the weldable wrapping material. Therefore, wrapping materials can be utilized which have lower purchase costs than weldable materials.

The new curtain of web material can be formed after each passage of an object without any great expense simultaneously with guiding a section of the web material along the rear side of the object.

Due to the extreme simplicity of the wrapping operation which comprises only very few steps, a high output is enabled using the method and the apparatus according to the present invention.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
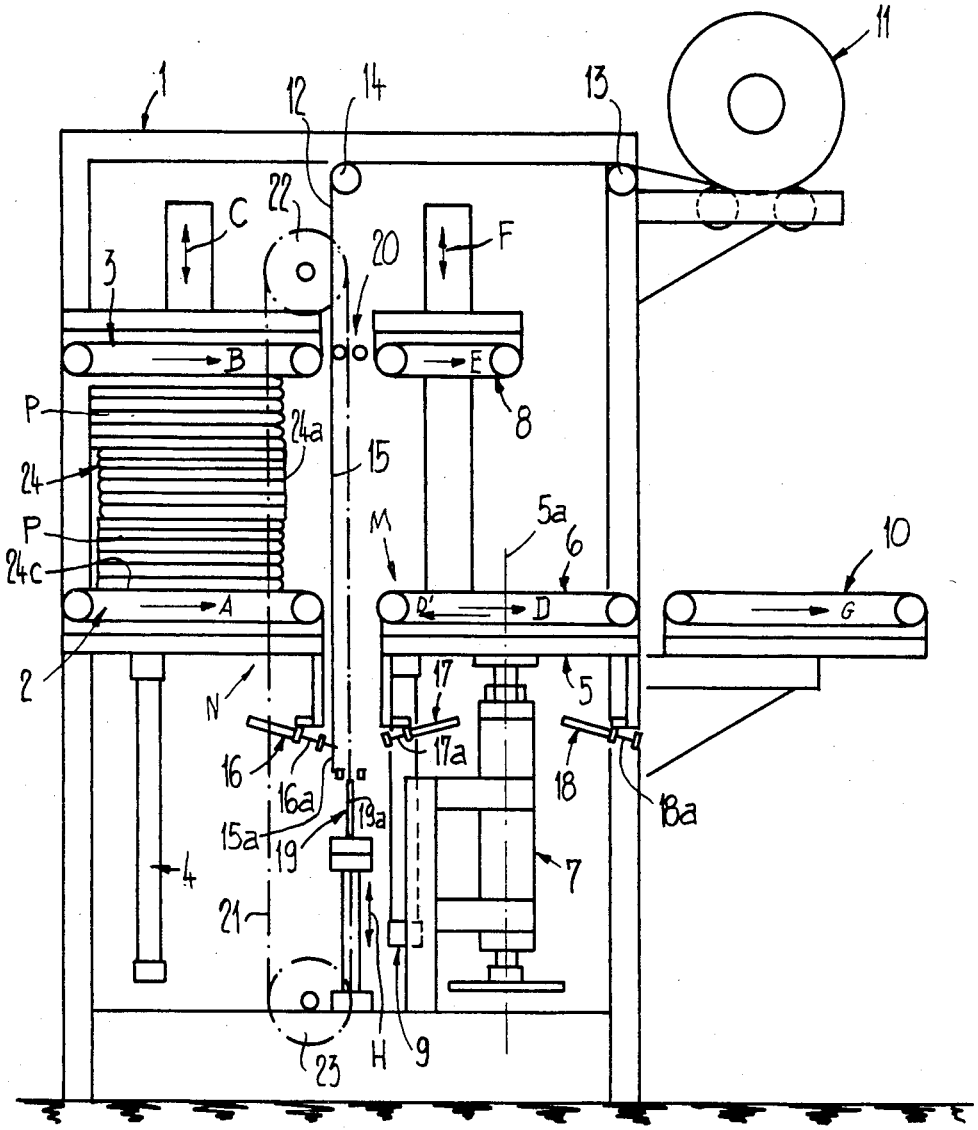
FIG. 1 is a side view of a first embodiment of the wrapping apparatus according to the invention.
Figure 3:
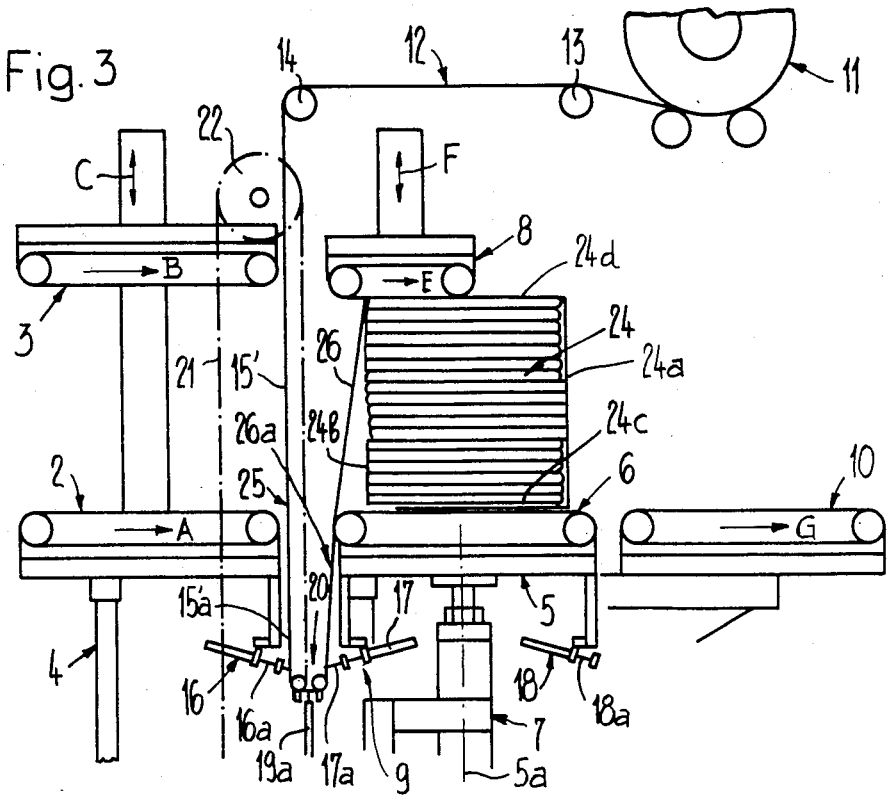
Figure 4:
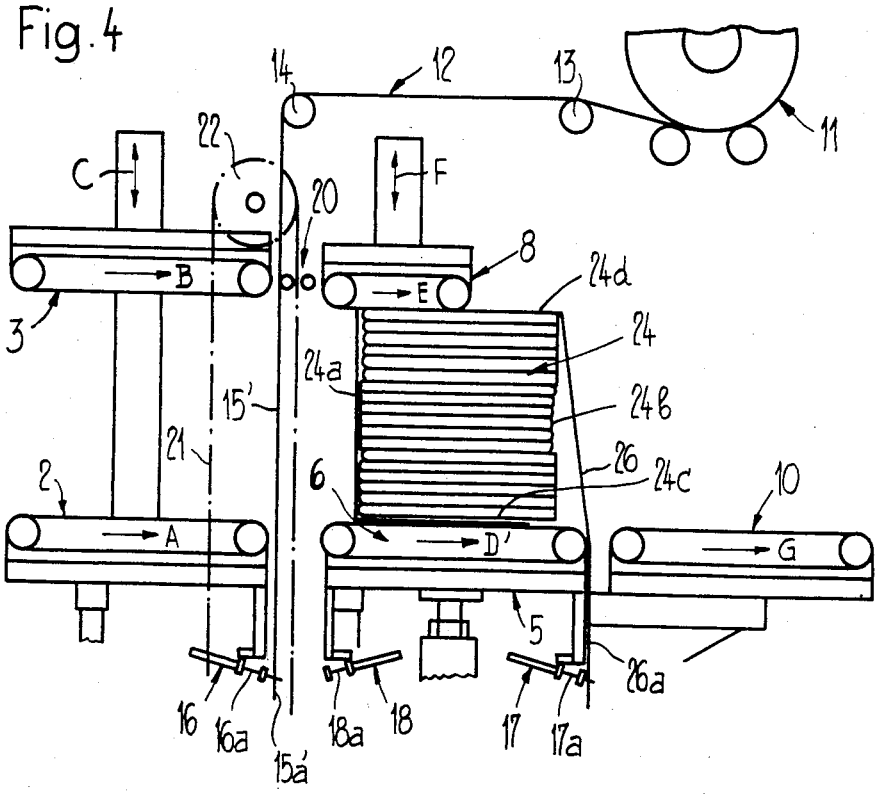
Figure 5:
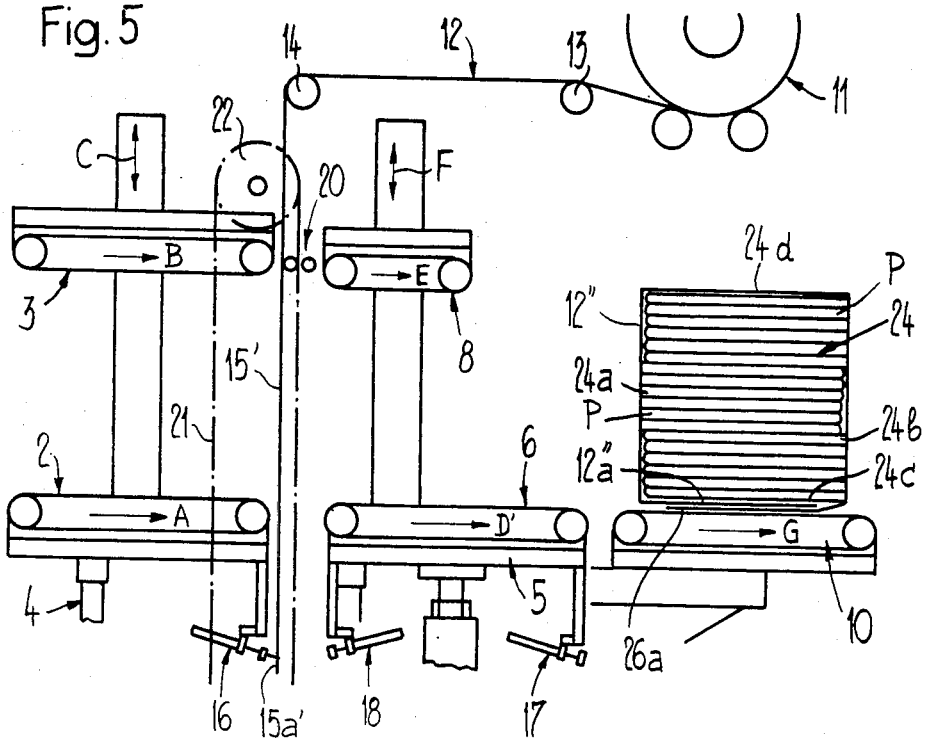
Figure 6:
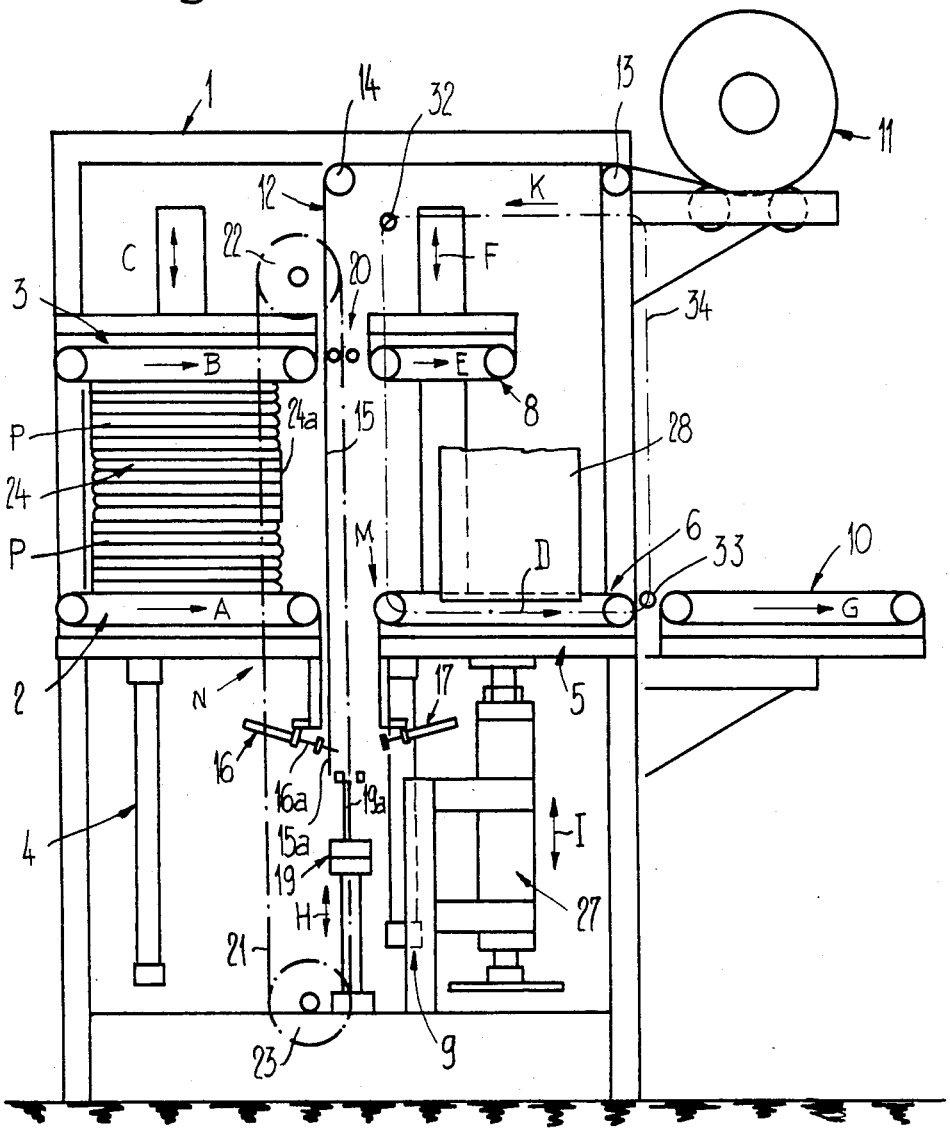
FIG. 6 is a side view of a second embodiment of the wrapping apparatus according to the invention.

Describing now the drawings, it is to be understood that only enough of the construction of the wrapping apparatus has been shown as needed for those skilled in the art to readily understand the underlying principles and concepts of the present development, while simplifying the showing of the drawings. Turning now specifically to FIGS. 1–5, there has been illustrated schematically therein a first embodiment of the wrapping apparatus according to the invention. Such wrapping apparatus comprises a support stand 1 which supports the various components of the wrapping apparatus. On the input side of the wrapping apparatus there are arranged conveying means comprising a first belt conveyor 2 which is stationarily mounted in the support stand 1. The first belt conveyor 2 can be driven in a predetermined conveying direction indicated by the arrow A. Above the first belt conveyor 2 there is arranged a second belt conveyor 3 which can be lifted or lowered in the direction of the double-headed arrow C by means of an elevator or displacing device 4. The conveying direction B of the second belt conveyor 3 extends parallel to the conveying direction A of the first belt conveyor 2. At a space in relation to and forwardly of the first belt conveyor 2, as seen in the predetermined conveying direction A, there is provided a support or support table 5 including conveyor means comprising a belt conveyor 6 which is vertically or elevationally aligned with the first belt conveyor 2 and which can be driven in two opposite directions D and D' as best seen in FIGS. 1, 4 and 5.

The support table 5 is supported on a rotating mechanism 7 including drive means for rotating the support table 5 about its vertically extending axis 5*a*. Above the support table 5 there is arranged a third belt conveyor 8 defining pressure means which can be driven in the direction of the arrow E and which can be lifted or lowered in the direction of the double-headed arrow F by means of a further elevator or elevating or displacing device 9. The third belt conveyor 8 substantially is at the same height as the second belt conveyor 3 operationally preceding the same and this third belt conveyor or pressure means 8 together with the support 5 defines a conveying channel for the object or article or package 24 to be wrapped.

On the output side of the wrapping apparatus there is supported at the support stand 1 a fourth belt conveyor 10 which is driven in the direction of the arrow G and which is aligned with the first belt conveyor 2 and the belt conveyor 6 on the support table 5. The aforementioned three belt conveyors 2, 6 and 10 define a predetermined conveying path of the object or article 24 or the like which is to be wrapped in a manner still to be described.

A single storage roll or supply means 11 is mounted on a first side M above the predetermined conveying path of the object to be wrapped and a substantially web-like wrapping material or web-like foil or web 12 is wound on the storage roll 11. In the presently described embodiment the wrapping material comprises a plastic foil or web 12 having self-adhesive properties like, for example, a polyvinylidene chloride foil which is commercially available under the designation or trademark "SARAN". The foil or web 12 is guided by a guiding roll or roller 13 and a deflection roll or roller 14 as it is withdrawn from the single storage roll or roller 11. As shown particularly in FIG. 1, a preselected length or web section or foil curtain 15 which follows the deflection roll 14 substantially extends in vertical direction, i.e. transversely relative to the predetermined conveying path of the object 24 to be wrapped. In the region of its free end 15*a* on a second side N of the predetermined conveying path the web section 15 is releasably held by stationarily arranged first holding means 16 comprising one or a number of needles 16*a* which are each displaceable in the direction of its longitudinal axis and which pierce the web or foil section 15 in their operative position. The web or foil section 15 is thus tensioned between the deflection roll 14 and the first holding means 16.

Two further or second holding means 17 and 18 are attached to the support table 5 on opposite sides of the rotational axis 5*a*. With respect to their structure the further holding means 17 and 18 correspond to the first holding means 16; they also comprise two or more needles 17*a* and 18*a*, respectively, each of which can be displaced in the direction of its longitudinal axis. In FIG. 1 the needles 17*a* and 18*a* are shown in their retracted inactive position. As still to be explained, in each inactive position of the support table 5 one of the two further holding means 17 or 18 is placed at a distance opposite to the first holding means 16.

Severing means or a separating device 19 is present below and intermediate the two opposite first and second holding means 16 and 17 and comprises a cutting knife or cutter 19*a* which can be lifted and lowered in the direction of the double-headed arrow H. In the intermediate space between the first belt conveyor 2 and the belt conveyor 6 on the support table 5 as well as between the second belt conveyor 3 and the third belt conveyor 8 and forwardly of the web or foil section 15, as seen in the conveying direction A, there are arranged withdrawal means including two rod-shaped entraining or entrainment elements 20 which are connected at their ends with drive elements 21 which are only schematically illustrated. The latter are guided at deflection rolls or rollers 22 and 23, one of which is a driven roll. The entraining elements 20 are displaced in substantially vertical direction between an upper end position which is shown in FIGS. 1, 2, 4 and 5 on the first side M of the predetermined conveying path and a lower end position which is shown in FIG. 3 on the second side N of the predetermined conveying path and in which the entraining elements 20 are located below the two oppositely arranged first and second holding means 16 and 17 and adjacent the severing means or separating device 19.

The object or article or the like to be wrapped is, as previously noted, designated by reference character 24 in the figures of the drawings. In the particular embodiment shown the object 24 constitutes a package of stacked compressible printed products P.

The wrapping operation of the package 24 of printed products P is conducted as follows:

By lifting and lowering the second belt conveyor 3 on the input side in the direction of the double-headed arrow C, the second belt conveyor 3 is adjusted to a height corresponding to a predetermined dimension of the package 24 to be wrapped. Subsequently this package 24 is introduced into a first position between the first belt conveyor 2 and the second belt conveyor 3. By slightly lowering the second belt conveyor 3 the package 24 is pressurized or squeezed so as to compress the printed products P. The third belt conveyor 8 is adjusted to the height of the preceding or upstream located second belt conveyor 3 by appropriate adjustment thereof in the direction of the double-headed arrow F. The first belt conveyor 2 and the second belt conveyor 3 are now driven in the predetermined conveying direction as indicated by the arrows A and B respectively. The package 24 is thus displaced towards the web or foil section 15 which is held under tension transversely relative to the predetermined conveying path of the package 24. When a front side 24*a* of the package 24 engages the web or foil section 15, the latter is entrained by the package 24. During its further movement the package 24 arrives at a position between the belt conveyor 6 on the support table 5 and the third belt conveyor or pressure means 8 and a foil section designated by 12' in FIG. 2 engages the package 24 on three sides 24*c*, 24*a* and and 24*d* in a substantially U-shaped configuration. To enable such engagement, the end 15*a* of the web section 15 is released from the first holding means 16 at a suitable moment while further foil material is withdrawn from the storage roll 11. During such withdrawal of the foil 12 care is taken for the foil section 12' to be under tension so it may snugly engage the package 24.

Figure 2:
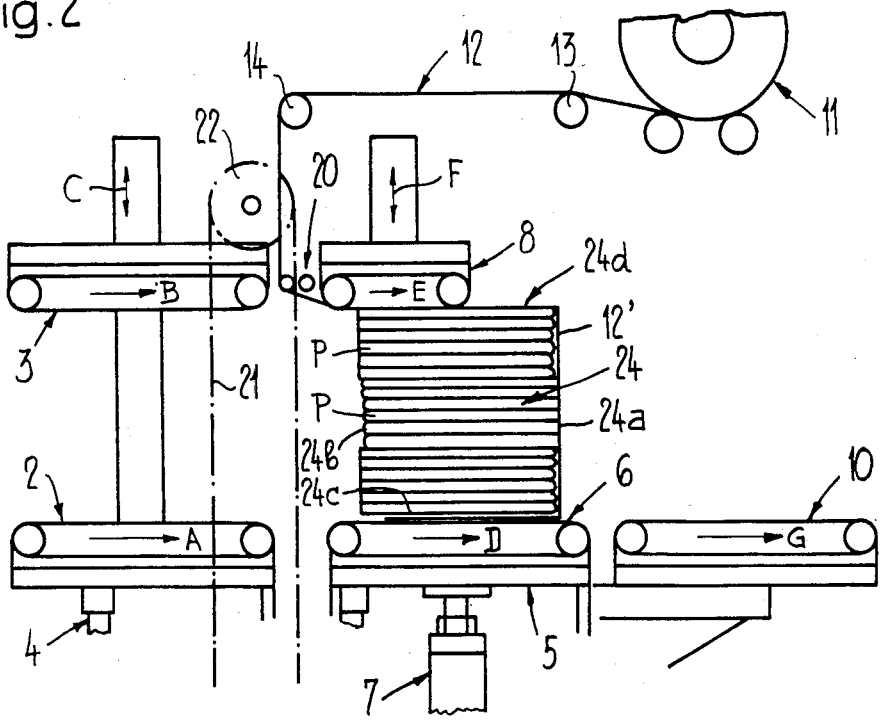
FIGS. 2–5 illustrate part of the wrapping apparatus as shown in FIG. 1 in different operational states thereof.

When the package 24 which is surrounded by the foil section 12' on three sides thereof and arrives at its second position as shown in FIG. 2, the drive means of the belt conveyor 6 on the support table 5 and of the third belt conveyor 8 are deactivated. The entraining elements 20 are now displaced from their upper end position which is shown in FIG. 2 into their lower end position which is shown in FIG. 3. As will be evident from FIG. 2, such entraining elements 20 in their upper end position are located above the foil section or portion which extends along the top side 24*d* of the package 24. Therefore, the foil 12 is downwardly entrained when the entraining elements 20 are downwardly displaced. During this movement further material of the foil 12 simultaneously is withdrawn from the storage roll 11 and a loop 25 is formed as illustrated in FIG. 3. Two foil runs form the loop 25 and are held in the region of their respective ends by the related first and second holding means 16 and 17. Subsequently, the two foil runs are separated from each other at the end of the loop 25 by means of the cutting knife 19*a* and form thereby a first section 15' and a second section 26 of the foil 12, respectively. The first section 15' of the foil which extends under tension between the deflection roll 14 and the first holding means 16 now corresponds to the web or foil section which has been designated by reference character 15 in FIG. 1. The second section 26 of the foil 12 extending along the rear side 24*b* of the package 24 is longer than the height of the package 24 by an end section designated by reference numeral 26*a* which thus protrudes past the package 24. As already mentioned this end section 26*a* is held by the second holding means 17.

After the two foil runs have been separated from each other, the entraining elements 20 are moved back again into their upper end position. As will be evident from FIG. 3, the second belt conveyor 3 also has been elevated somewhat during this time, so that the first belt conveyor 2 and the second belt conveyor 3 are prepared to again receive a further object or package 24.

As will be recognized from the preceding discussion, a web or foil section or foil curtain 15 is newly extended under tension as the second section 26 of the foil 12 is guided along the rear side 24b of the package 24. The foil section or curtain 15 is intended to be applied in a substantially U-shape around the next following package 24 in the manner as described hereinbefore.

During a next step of the wrapping operation the third belt conveyor 8 is appropriately slightly lifted and then the support table 5 is rotated through an angle of approximately 180° about its axis 5a using the drive means of the rotating mechanism 7. In FIG. 4 the support table 5 is shown in the position it assumes after the rotation has been performed. In this rotated position of the support table 5 the third belt conveyor 8 is again lowered onto the package 24. The belt conveyor 6 on the support table 5 and the third belt conveyor 8 are then driven in the direction indicated by the respective arrows D' and E and the package 24 is thereby forwardly moved or advanced in the direction of such arrows D' and E towards the fourth belt conveyor 10 on the output side of the wrapping apparatus. During such movement the second section 26 of the foil 12 engages the leading side 24b of the package 24 which originally was the rear side thereof, while the protruding end section 26a of the second foil section 26 after release from the second holding means 17 is displaced towards and against the bearing surface 24c, defining a bottom surface, of the package 24. The displaced protruding end section 26a contacts the foil section which is designated 12a'' in FIG. 5 and which foil section 12a'' has been applied to this bearing surface 24c by the substantially U-shaped application of the web or foil section 15 to the package 24. Due to the self-adhesive properties of the wrapping foil 12 the two contacting foil sections 26a and 12a'' form a lasting though releasable bond. Since the two overlapping foil sections 26a and 12a'' are loaded with the weight of the package 24, there is prevented an unintentional loosening of the foil section 12'' which snugly encloses the package 24, as shown in FIG. 5. During the wrapping operation, as already mentioned, the package 24 is compressed by means of the second belt conveyor 3 and the third belt conveyor or pressure means 8. When such pressing action ceases, the printed products P relax and as a consequence the height of the package 24 is somewhat increased. This now results in the foil section 12'' being still more snugly attached to the package 24.

The package 24 wrapped into the foil section 12'' is then transferred to a carry-off or outfeed conveyor by the fourth belt conveyor 10 and hence the package 24 is conveyed to a suitable location for further processing. During such further conveyance the printed products P which are wrapped into the foil section 12'' cannot fall apart. The printed products P furthermore are protected by this foil section 12''. If desired, the finished package 24 can still be tied up using a cord.

The second embodiment of the wrapping apparatus according to the invention as illustrated in FIGS. 6–15 in many of its parts corresponds to the embodiment illustrated by FIGS. 1–5 with respect to structure and function. For this reason corresponding parts or components shown in FIGS. 6–15 generally have the same reference numerals or characters as in FIGS. 1–5. The function and structure of this second embodiment is described in the following only with respect to the differences over the first embodiment.

Figure 13:
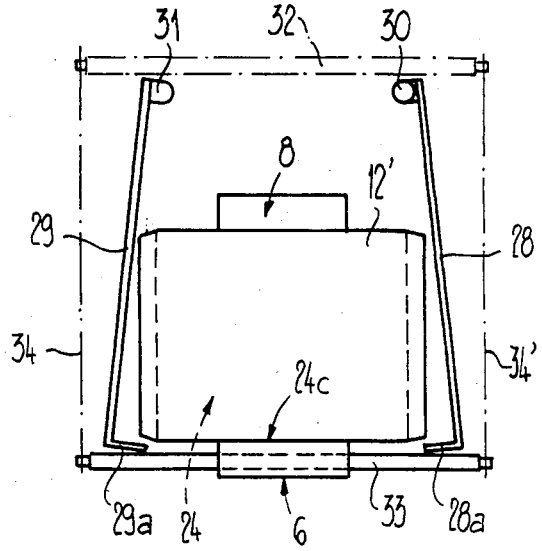
FIG. 13 is a section along the line XIII—XIII in FIG. 7.
Figure 14:
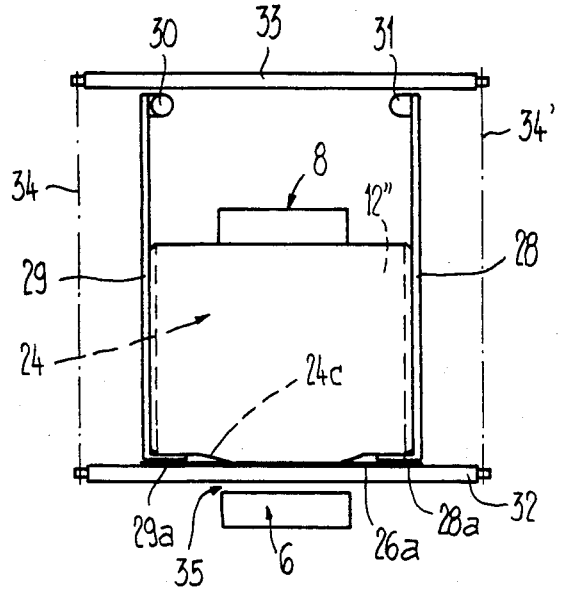
FIG. 14 is a section along the line XIV—XIV in FIG. 10.
Figure 15:
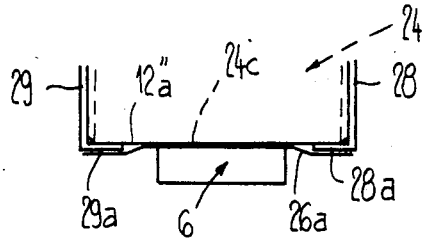
FIG. 15 is a section along the line XV—XV in FIG. 11.

Contrary to the first embodiment as illustrated in FIGS. 1–5, the second embodiment comprises a support or support table 5 which is not rotatable, but instead can be lifted or lowered in the directions of the double-headed arrow I by means of an elevator or elevating mechanism or displacing device 27. Furthermore, there are present in this second embodiment two substantially U-shaped retaining or support elements 28 and 29 which are arranged on opposite sides of the predetermined conveying path of the object or package 24, as shown in FIG. 13. Each of the two retaining or support elements 28 and 29 can be pivoted about a related axis or pivot shaft 30, 31 which extends substantially parallel to the movement direction of the object 24, and comprises related bent-off retaining or support members 28a, 29a at the ends thereof which are located remote from the axes or pivot shafts 30, 31. As shown in FIG. 13–15, the belt conveyor 6 on the support table 5 is less wide than the package 24.

There are furthermore present in this second embodiment two rod-shaped folding elements 32 and 33 which extend transversely to the predetermined conveying path of the package 24 and which are connected to drive elements 34, 34' at their ends. The latter can be appropriately driven in a manner not shown in any particular detail and in such a way that the folding elements 32, 33 are displaced in the direction of the arrow K along a closed or endless revolving path. In their inactive position the folding elements 32 and 33 are placed opposite each other as shown in FIGS. 6–8 and 10–12.

As will be apparent by comparing FIGS. 6–8 and FIGS. 1–3, the first step of the wrapping operation, namely the substantially U-shaped application of the web section 15 of the web material to three sides of the package 24, is conducted in exactly the same way in the two embodiments. Contrary thereto, the displacement of the protruding end section 26a of the second section 26 of the foil 12 under the package 24 is performed in a different manner in the second embodiment as compared to the first. In the following the folding of the protruding end section 26a will now be explained in more detail.

Figure 7:
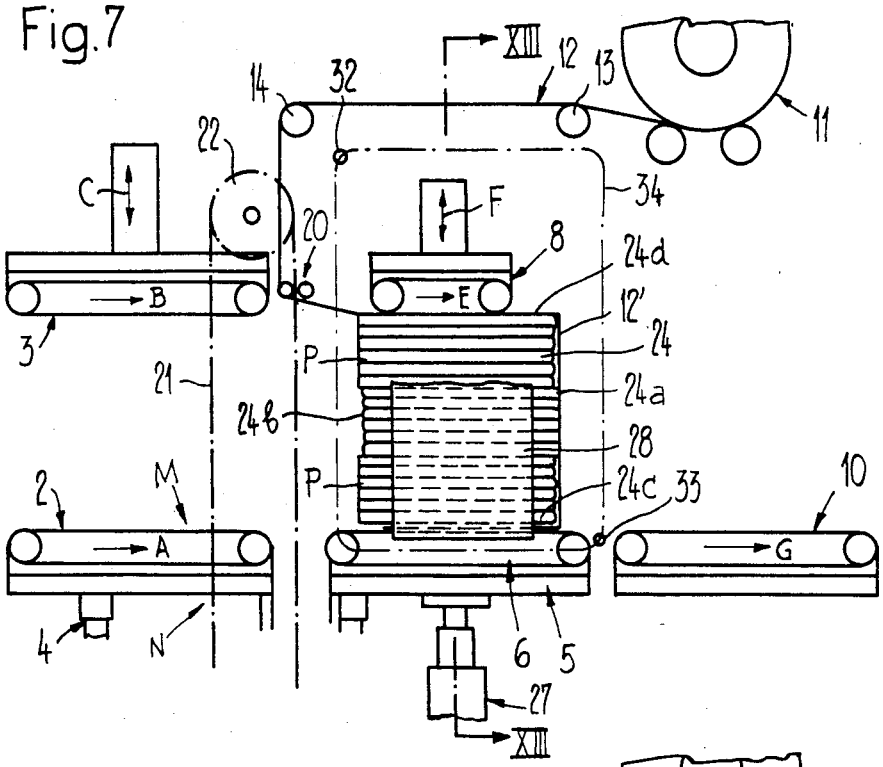
FIGS. 7–12 illustrate part of the wrapping apparatus as shown in FIG. 6 in various operational states thereof.
Figure 8:
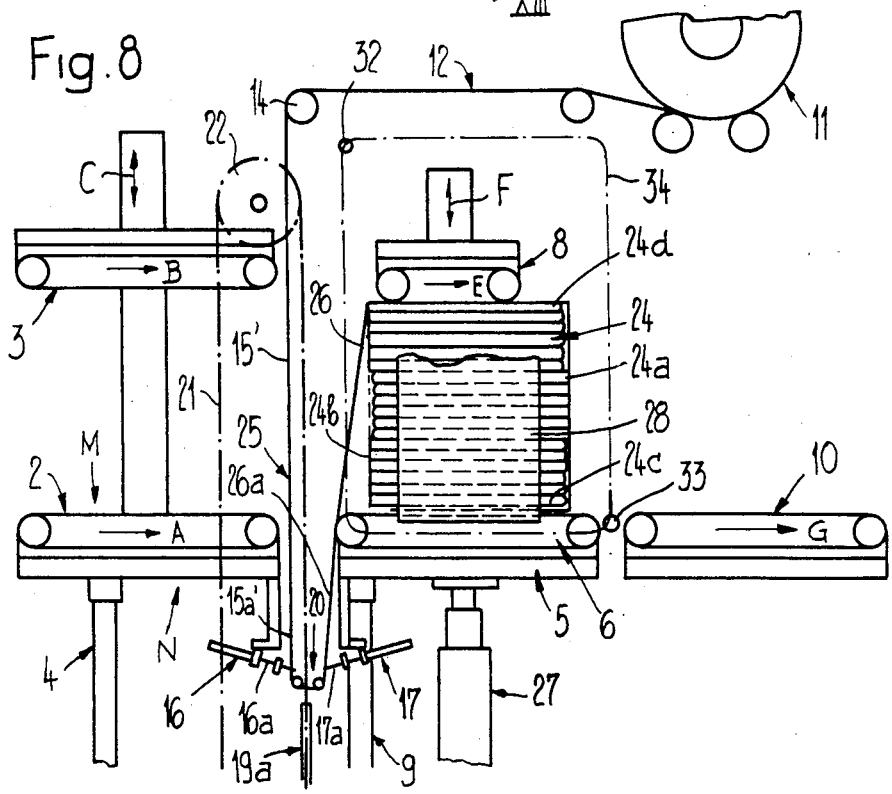
Figure 9:
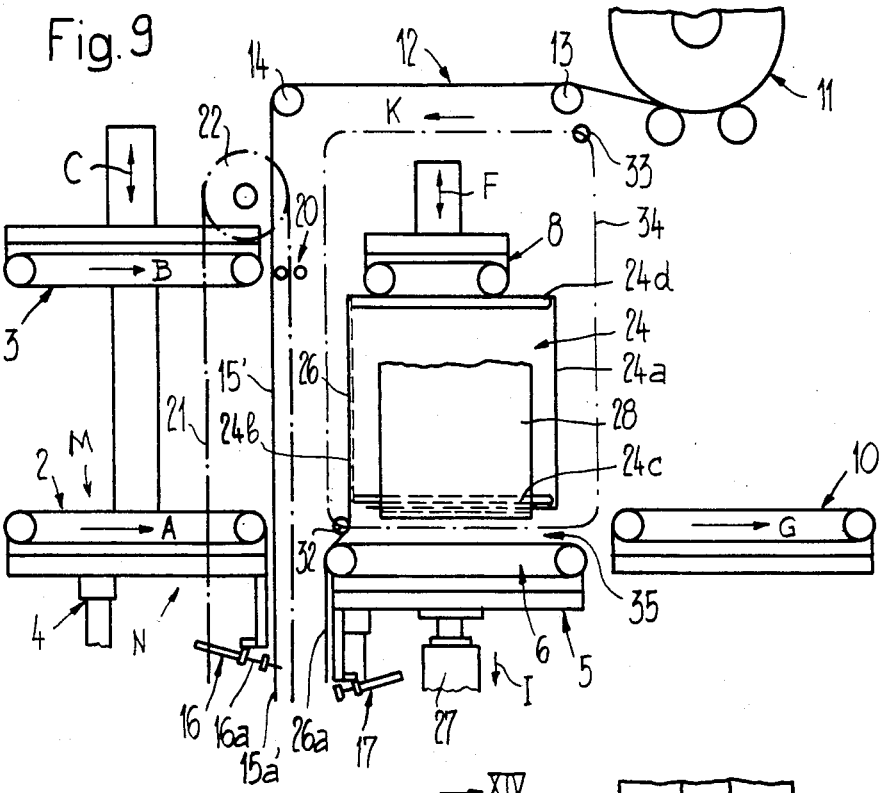
Figure 10:
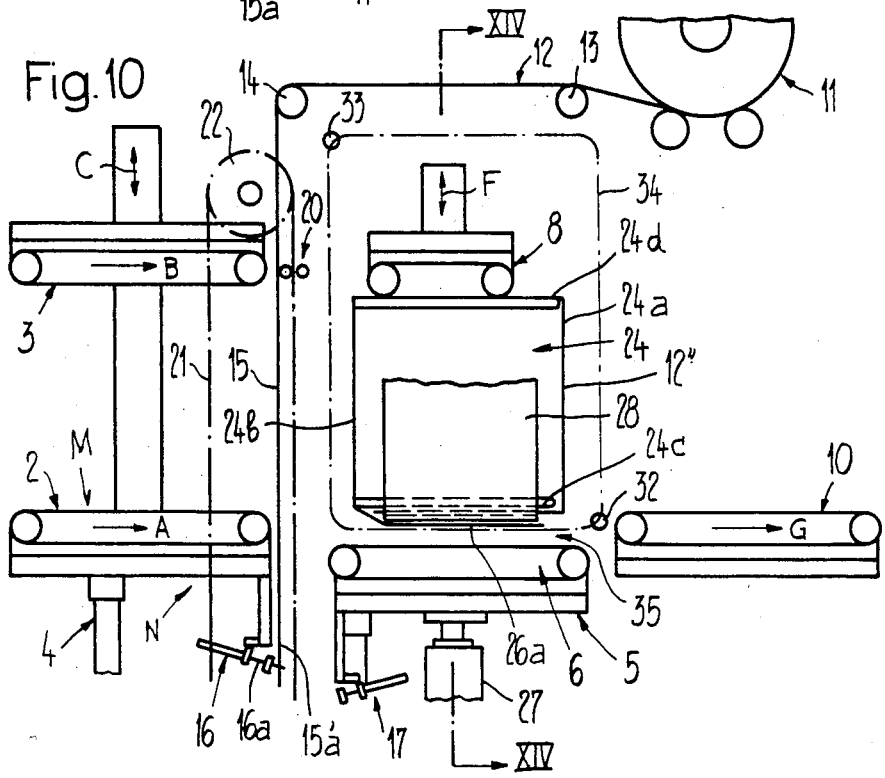

As will be evident from FIGS. 7 and 13, the retaining or support elements 28 and 29 are shown pivoted away from the package 24 and in their stand-by or preparatory position. That means that in the stand-by position the retaining members 28a, 29a do not extend below the package 24. During the formation of the loop 25 the retaining elements 28, 29 are now pivoted into their active position in which the retaining members 28a, 29a thereof are positioned below the package 24. As soon as the first and second sections 15' and 26 have been formed by separating the two loop runs from each other using the cutting knife 19a, the support table 5 is lowered in the corresponding direction of the double-headed arrow I, see FIG. 9. During this movement the package 24 comes to bear with its bearing surface 24c upon the retaining members 28a, 29a of the retaining elements 28, 29 which are now located in their active positions. In this manner an intermediate space 35 is formed between the package 24 and the support table 5, i.e. the belt conveyor 6. Simultaneously the folding elements 32 and 33 are set in motion in the direction of the arrow K. As shown in FIG. 9, during such movement the folding element 32 acts upon the protruding end section 26a of the second section 26 of the foil 12. During the further displacement of this folding element 32 through the intermediate space 35 such protruding end section 26a, which in the meantime has been released from the second holding means 17, is placed under the package 24. As will be evident from FIGS. 10 and 14, the retaining members 28*a*, 29*a* of the retaining elements 28, 29 will be placed between the package 24 and the protruding end section 26*a* folded thereunder as a result of this movement. When the folding element 32 has left the intermediate space 35, the folding elements 32, 33 are inactivated. The other folding element 33 is now prepared for folding another protruding end section 26*a* beneath the next package 24.

Figure 11:
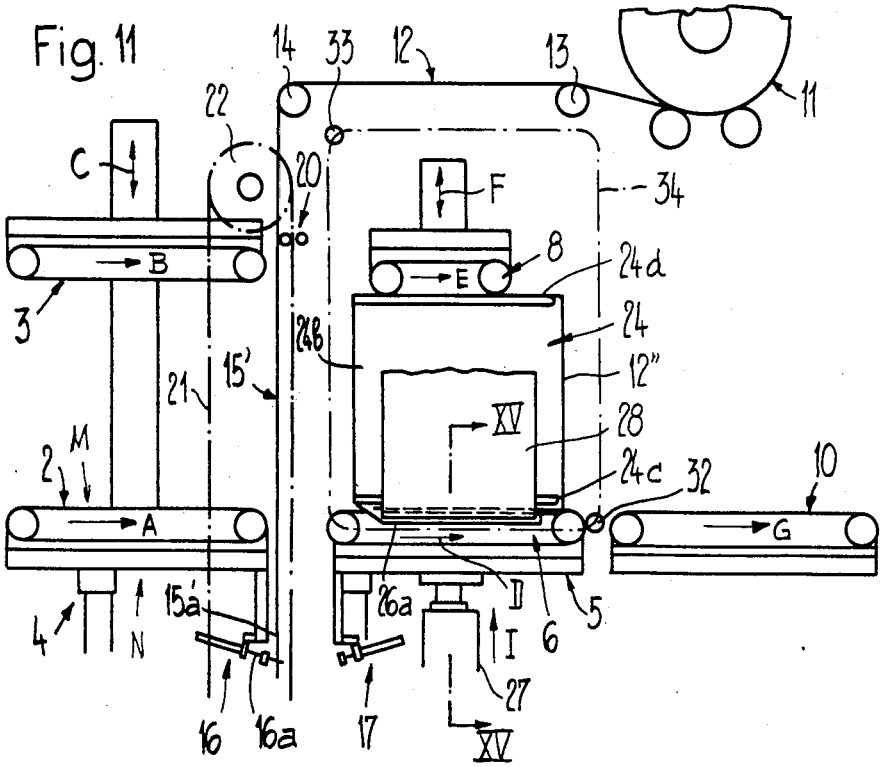

The support table 5 is now lifted again using the elevator or elevating mechanism 27, so that the package 24 again comes to rest on the belt conveyor 6 of the support table 5, see FIGS. 11 and 15. During this movement the end section 26*a* and section 12*a*″ of the foil section 12″ which encloses the package 24, are pressed against each other in their overlapping state. The retaining members 28*a*, 29*a* are withdrawn from beneath the package 24 by laterally pivoting the retaining elements 28 and 29. Such withdrawal of the retaining members 28*a*, 29*a* which are arranged between the foil end sections 26*a* and 12*a*″, can occur without any problems because, as already mentioned, the two foil end sections 26*a* and 12*a*″ are held in mutual contact by means of the belt conveyor 6 on the support table 5, the weight of the package 24 as well as by the pressing force exerted by the third belt conveyor 8 on the top.

Figure 12:
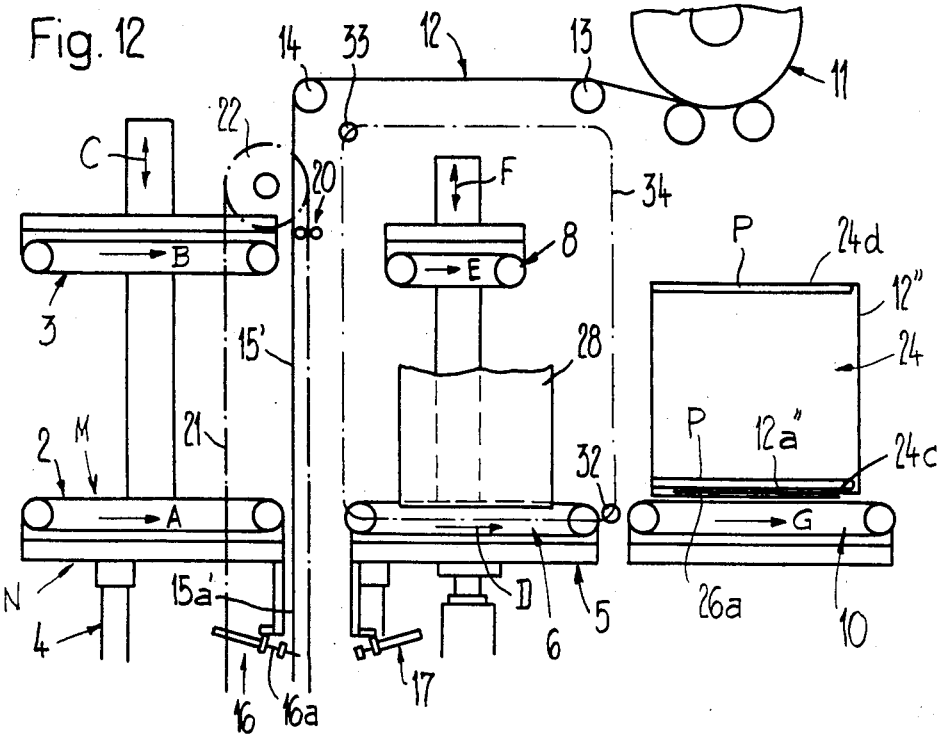

The package 24 is now completely wrapped and is transferred to the fourth belt conveyor 10 on the output side by driving the belt conveyor 6 on the support table 5 and the third belt conveyor 8 in the direction of the respective arrows D and E, as illustrated in FIG. 12 which corresponds to FIG. 5.

As compared to the first embodiment illustrated by FIGS. 1–5 the advantage of the second embodiment shown in FIGS. 6–15 is that due to the elimination of a rotary movement of the support table 5 the wrapping cycle requires less time and thus enables a higher output.

It will be understood that the two embodiments can be differently designed with respect to various members as compared to those shown in the drawings and described hereinbefore by way of illustration and not limitation. Thus, for example, it can be convenient to hold the ends of the first and second sections 15′ and 26 of the foil 12 in a different manner than by using the needles 16*a*, 17*a*, 18*a*, for example, by using sub-atmospheric pressure or vacuum.

Although due to its self-adhesive properties, a polyvinylidene chloride foil is particularly suited as a wrapping material, it will be self-evident that it is also possible to use different materials, for example, apart from other plastic foils or webs also paper webs. In the use of such materials, however, it may be required to use gluing or other suitable techniques which provide an interconnection between the two overlapping end sections 26*a*, 12*a*″.

It will be understood that the apparatus as described hereinbefore can also be used to wrap other objects than packages comprising stacked printed products.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A method of wrapping compressible quadrangular packages formed by stacked substantially flat products, for example, printed products, in a substantially web-like wrapping material, said method comprising the steps of:

withdrawing substantially web-like wrapping material from a single storage roll so as to form a free end region and so as to extend transversely relative to a predetermined conveying direction of the package to be wrapped;

holding said free end region and thereby holding under tension said withdrawn web-like wrapping material;

compressing said compressible package in a direction substantially perpendicular to said predetermined conveying direction;

during a first step of the wrapping operation conveying the compressed package to be wrapped in said predetermined conveying direction towards said web-like wrapping material extended under tension transversely relative to said predetermined conveying direction;

during a further movement of said compressed package during said first step of the wrapping operation releasing said held free end region of said web-like wrapping material in a manner such that the web-like wrapping material is placed around said compressed package in a substantially U-shape under tension and in contact with a top side of said object;

holding said compressed package in the compressed state during said further movement of said compressed package and placement of the web-like wrapping material around said compressed package in a substantially U-shape;

during a second step of the wrapping operation withdrawing further web-like wrapping material from said single storage roll and simultaneously guiding on a rear side of said compressed package a first section of the web-like wrapping material so as to form an end region and so as to extend transversely relative to said predetermined conveying direction and a second section of said web-like wrapping material which has a length greater than the dimension of said compressed package in the direction of extension of said second section of said web-like wrapping material, so that a protruding end section thereof is obtained;

holding said end region and thereby holding under tension said first section of said withdrawn web-like wrapping material;

holding said protruding end section and thereby holding under tension said second of said withdrawn further web-like wrapping material;

during a third step of the wrapping operation displacing relative to each other said compressed package and said second section of the withdrawn further web-like wrapping material and releasing the held protruding end section of said second section and thereby placing said second section under tension towards and against said rear side and a side contiguous with said rear side of said compressed package; and said third step of said wrapping operation entailing transiently and at least partially holding said compressed package under reduced compression.

2. The method as defined in claim 1, further including the steps of:

conveying said compressed package along a predetermined conveying path in said predetermined conveying direction; and arranging said single storage roll above said predetermined conveying path.

3. The method as defined in claim 2, further including the steps of:

during said second step of the wrapping operation when there is withdrawn said further web-like wrapping material, forming a loop with an end and a first run from which there is to be formed said first section and a second run from which there is to be formed said second section; and placing said end of said loop on a side of said predetermined conveying path of said compressed package and which side is opposite the side thereof on which said storage roll is arranged.

4. The method as defined in claim 3, further including the steps of:

holding said first run and said second run of said loop at predetermined end regions: and separating from each other said first run and said second run of said loop and thereby forming and holding under tension said first section and said second section of said withdrawn further web-like wrapping material.

5. The method as defined in claim 4, further including the steps of:

during said third step of the wrapping operation rotating said object about an axis extending substantially at right angles to said predetermined conveying direction;

subsequently conveying said object in said predetermined conveying direction with said side thereof which originally formed said rear side now forming a front side thereof;

whereby said protruding end section of said second section of the web-like wrapping material, which prior to said rotation was located on the rear side of said object, is displaced towards and against said object.

6. The method as defined in claim 5, further including the step of:

rotating said object through an angle of approximately 180°.

7. The method as defined in claim 1, further including the step of:

during said third step of the wrapping operation displacing said protruding end section of said second section of the web-like wrapping material which is guided along said rear side of said object, towards and against said side contiguous with said rear side of said compressed package which is transiently and at least partially held under reduced compression; and recompressing said package which is transiently and at least partially held under reduced compression.

8. The method as defiend in claim 7, further including the step of:

displacing said protruding end section during said third step of the wrapping operation towards and against said side contiguous with said rear side and constituting a bearing surface of said compressed package which is transiently and at least partially held under reduced compression.

9. The method as defined in claim 7, further including the steps of:

placing said compressed package with a bottom side as said side which is contiguous with said rear side thereof on a support prior to said third step of the wrapping operation;

during said step of transiently and at least partially holding said compressed package under reduced compression, forming a space between said compressed package which is transiently and at least partially held under reduced compression and said support; and after said step of displacing said protruding end section of said second section of the withdrawn further web-like wrapping material towards and against said bottom side of said compressed package which is transiently and at least partially held under reduced compression, recompressing said compressed package which was transiently and at least partially held under reduced compression and bringing the recompressed package to bear on said support.

10. The method as defined in claim 1, further including the step of:

utilizing as the web-like wrapping material a plastic foil having self-adhesive properties.

11. The method as defined in claim 10, further including the step of:

utilizing as the self-adhesive web-like wrapping material a plastic foil which is made of polyvinylidene chloride.

12. A method of wrapping compressible quadrangular block-like objects, particularly packages formed by stacked substantially flat products, for example, printed products, in a substantially web-like wrapping material, said method comprising the steps of:

withdrawing substantially web-like wrapping material from a single storage roll so as to form a free end and releasably holding the withdrawn web-like wrapping material at the region of its free end so as to extend under tension transversely relative to a predetermined conveying direction of the object to be wrapped;

during a first step of the wrapping operation conveying the object to be wrapped in said predetermined conveying direction towards said web-like wrapping material extended under tension transversely relative to said conveying direction;

during a further movement of said object during said first step of the wrapping operation releasing said free end region of said web-like wrapping material in a manner such that the web-like wrapping material is placed around said object in a substantially U-shaped while being held under tension and contacts a top side of said object;

compressing said object during said further movement of said object and placement of the web-like wrapping material around said object in a substantially U-shape;

during a second step of the wrapping operation withdrawing further web-like wrapping material from said single storage roll and simutlaneously guiding on a rear side of said object a first section of the web-like wrapping material which extends under tension transversely relative to said predetermined conveying direction of the object while releasably holding a predetermined portion of said first section, and guiding a second section of said web-like wrapping material which has a length greater than the dimension of said object in the direction of said second section of said web-like wrapping material, so that a protruding end section thereof is obtained;

during a third step of the wrapping operation displacing said end section of said second section of the web-like wrapping material towards and against said object to be wrapped;

during said third step of the wrapping operation displacing said protruding end section of said second section of the web-like wrapping material which is guided along said rear side of said object, towards and against a side of said object which is contiguous with said rear side thereof;

placing said object with a bottom side thereof on a support;

during said third step of the wrapping operation forming a space between said object and said support;

subsequently displacing said protruding end section of said second section of the web-like wrapping material which extends along said rear side of said object, towards and against said bottom side of said object; and bringing said object to against bear on said support.

13. An apparatus for wrapping compressible, quadrangular packages formed by substantially flat products, for example, printed products, in a substantially web-like wrapping material, comprising:

conveying means for conveying a package which has a predetermined dimension and which is to be wrapped, in a predetermined conveying direction along a predetermined conveying path from a first position to a second position;

said package to be wrapped defining a rear side relative to said predetermined conveying direction;

a single storage roll holding a supply of said substantially web-like wrapping material and arranged on a first side of said predetermined conveying path;

a preselected length of said substantially web-like wrapping material extending, in the operative state of the apparatus and in said first position of said package to be wrapped on its front side relative to said predetermined conveying direction, from said first side of said predetermined conveying path and possessing a free end on a second side of said predetermined conveying path;

withdrawal means for withdrawing and guiding said substantially web-like wrapping material from said storage roll in order to extend transversely relative to said predetermined conveying path and to form a free end region on said second side of said predetermined conveying path;

said withdrawal means being displaceable between an upper end position on said first side of said predetermined conveying path and a lower end position on said second side of said predetermined conveying path;

first holding means arranged on said second side of said predetermined conveying path and holding said free end region and thereby holding under tension said withdrawn web-like wrapping material in said first position of said package to be wrapped;

compressing means operatively associated with said package in order to form a compressed package at least in said second position of said package;

said package to be wrapped, after being conveyed into said second position and compressed by said compressing means after release of said free end region of said substantially web-like wrapping material from said first holding means, being surrounded under tension substantially in a U-shape on three sides by at least said preselected length of said substantially web-like wrapping material;

said withdrawal means in said upper end position and in said second position of said compressed package to be wrapped being arranged above the substantially web-like wrapping material which extends from said single storage roll and surrounds said compressed package on said three sides thereof;

said withdrawal means, during its displacement from said upper end position to said lower end position, withdrawing from said single storage roll said substantially web-like wrapping material which thereby forms, in said second position on said rear side of said compressed package to be wrapped, a first section which substantially conforms to said preselected length of said substantially web-like wrapping material, and a second section which has a length greater than said predetermined dimension of said compressed package to be wrapped and contains an end section protruding past said object to be wrapped;

second holding means arranged on said second side of said predetermined conveying path and holding said protruding end section and thereby holding under tension said second section of said withdrawn substantially web-like wrapping material;

a support for supporting in said second position the compressed package to be wrapped;

said support being arranged, as seen in said predetermined conveying direction, forwardly of the web-like wrapping material held to extend under tension transversely relative to said predetermined conveying direction;

said compressing means being arranged above said support and defining together with said support a conveying channel for the compressed package to be wrapped;

displacing means for displacing relative to each other said compressed package and said protruding end section in order to thereby place under tension said second section inclusive of said protruding end section of said withdrawn substantially web-like wrapping material, after release from said second holding means, towards and against said rear side and a side contiguous with said rear side of said compressed package; and said compressing means transiently and at least partially holding said compressed package under reduced compression in order to permit said displacing means to complete said wrapping operation.

14. The apparatus as defined in claim 13, wherein:

said single storage roll arranged on said first side of said predetermined conveying path is located above said predetermined conveying path of said package.

15. The apparatus as defined in claim 13, wherein:

said displacing means placing said protruding end section of said second section of the withdrawn web-like wrapping material towards and against said side contiguous with said rear side of said compressed package which is transiently and partially held under reduced compression by said compressing means.

16. The apparatus as defined in claim 15, wherein:

said side contiguous to said rear side constituting a bearing side of said compressed package.

17. The apparatus as defined in claim 16, wherein:

said support comprises conveyor means;

said conveyor means being arranged in said predetermined conveying direction forwardly of the web-like wrapping material held to extend under tension transversely relative to said predetermined conveying direction;

said support and said conveyor means forming part of said compressing means and being displaceable between an upper and a lower position;

said conveyor means, in said upper position of said support, supporting said compressed package to be wrapped in said second position at said bearing side of said compressed package to be wrapped;

retaining means operatively associated with said compressing means for holding said compressed package to be wrapped transiently and at least partially under reduced compression and at a predetermined spacing from said support and said conveyor means during the displacement of said support and said conveyor means from said upper position to said lower position and vice versa; and said displacing means comprising folding means for folding said protruding end section of said second section of the web-like wrapping material towards and against said bearing side constituting a bottom side of said compressed package transiently held at said predetermined spacing from said support and said conveyor means.

18. The apparatus as defined in claim 17, further inncluding:

severing means to sever a loop of the web-like wrapping material withdrawn by said withdrawal means; and said second holding means being connected to said support.

19. The apparatus as defined in claim 17, wherein:

said retaining means comprise two retaining elements oppositely arranged relative to the compressed package to be wrapped;

said retaining elements being displaceable between an inactive position and an active position; and said retaining elements in their active position transiently gripping the compressed package to be wrapped at said bottom side of said compressed package to be wrapped.

20. The apparatus as defined in claim 19, wherein:

said folding means comprising at least one folding element; and said at least one folding element being moveable through said predetermined spacing formed between said support inclusive of said conveyor means in their lower position and said compressed package transiently and at least partially held under reduced compression by said retaining means.

21. The apparatus as defined in claim 17, further including:

displacing means for transiently displacing said support from its upper position to its lower position and vice versa;

said displacing means containing drive means for displacing said folding means from a first position to a second position along said bottom side of said compressed package to be wrapped in said second position of said compressed package to be wrapped;

activating means for reversibly and transiently placing said retaining means into an active position for transiently retaining said compressed package to be wrapped at its bottom side;

said support including said conveyor means being displaced by said displacing means into its lower position and said retaining means being transiently placed by said activating means into their active position and retaining said compressed package to be wrapped on its bottom side, during the displacement of said folding means by said drive means from said first position to said second position whereby said protruding end section of said second section of the web-like wrapping material is folded towards and against said bottom side of said compressed package to be wrapped; and said support, in said second position of said folding means, being returnend into its upper position by said displacing means and supporting, by means of said conveyor means, said compressed package to be wrapped on said bottom side of said compressed package to be wrapped and to which part of said preselected length and said protruding end section of said wrapping material are applied.

22. The apparatus as defined in claim 17, wherein:

said conveyor means associated with said support is a belt conveyor.

23. The apparatus as defined in claim 13, wherein:

said withdrawing means for withdrawing said web-like wrapping material from said single storage roll forming, when operated, a loop comprising a first run from which there is to be formed said first section, a second run from which there is to be formed said second section and an end of said web-like wrapping material; and said end of said loop being located opposite said single storage roll relative to said predetermined conveying path.

24. The apparatus as defined in claim 23, wherein:

said withdrawal means comprise entraining means arranged in said upper end position and displaceable into said lower end position of said withdrawal means with respect to said predetermined conveying path of said object to be wrapped; and said entraining means, during displacement of said withdrawal means from said upper end position to said lower end position, acting on the length of the web-like wrapping material placed around said object in a substantially U-shape and connected to said single storage roll, to form said loop of the web-like wrapping material.

25. The apparatus as defined in claim 24, wherein:

said entraining means are located in the lower end position of said withdrawal means, on said second side and below said predetermined conveying path of said object to be wrapped.

26. The apparatus as defined in claim 23, further including:

severing means to sever said loop of the web-like wrapping material.

27. The apparatus as defined in claim 13, wherein:

said support being rotatable about an axis extending at right angles relative to said predetermined conveying direction defined by said conveying means;

drive means for rotating said support about a predetermined angle of rotation; and said conveying means including conveyor means to convey said object after rotation of said support about said predetermined angle with said side thereof which originally formed said rear side now forming the front side.

28. The apparatus as claimed in claim 27, wherein:

said predetermined angle of rotation of said rotatable support amounts to about 180°.

29. The apparatus as defined in claim 27, wherein: said conveyor means comprise a belt conveyor.

30. The apparatus as defined in claim 29, wherein: said rotatable support comprises a rotatably arranged belt conveyor.

31. The apparatus as defined in claim 27, further including:

severing means to sever a loop of the web-like wrapping material;

second holding means for releasably holding the second section of the web-like wrapping material at the region of the free end thereof after the first section and the second section of the web-like wrapping material have been separated from each other by said severing means; and said second holding means being arranged so as to be rotatable conjointly with said support.

32. The apparatus as defined in claim 13, wherein: said wrapping material comprises a plastic web having self-adhesive properties.

33. The apparatus as defined in claim 32, wherein: said plastic web having self-adhesive properties comprises a polyvinylidene chloride foil.

34. The apparatus as defined in claim 13, wherein; said compressing means comprise conveying means for conveying the compressed package to be wrapped in said predetermined conveying direction and arranged at a vertical spacing from said support.

35. The apparatus as defined in claim 34, wherein: said conveying means of said compressing means are movable towards and away from said support.

36. An apparatus for wrapping compressible, quadrangular block-like objects, particularly packages formed by substantially flat products, for example, printed products, in a substantially web-like wrapping material, comprising:

conveying means for conveying an object which has a predetermined dimension and which is to be wrapped, in a predetermined conveying direction along a predetermined conveying path from a first position to a second position;

said object to be wrapped defining a rear side relative to said predetermined conveying direction;

a single storage roll holding a supply of said substantially web-like wrapping material and arranged on a first side of said predetermined conveying path;

a preselected length of said substantially web-like wrapping material extending, in the operative state of the apparatus and in said first position of said object to be wrapped on its front side relative to said predetermined conveying direction, from said first side of said predetermined conveying path and possessing a free end on a second side of said predetermined conveying path;

withdrawal means for withdrawing and guiding said substantially web-like wrapping material from said storage roll in order to extend transversely relative to said predetermined conveying path and to form a free end on said second side of said predetermined conveying path;

said withdrawal means being displaceable between an upper end position on said first side of said predetermined conveying path and a lower end position on said second side of said predetermined conveying path;

first holding means arranged on said second side of said predetermined conveying path and releasably holding said free end of said web-like wrapping material in said first position of said object to be wrapped;

said object to be wrapped, after being conveyed into said second position and after release of said free end of said substantially web-like wrapping material from said first holding means, being surrounded substantially in a U-shape on three sides by at least said preselected length of said substantially web-like wrapping material;

said withdrawal means in said upper end position and in said second position of said object to be wrapped being arranged above the substantially web-like wrapping material which extends from said single storage roll and surrounds said object on said three sides thereof;

said withdrawal means, during its displacement from said upper end position to said lower end position, withdrawing from said single storage roll said substantially web-like wrapping material which thereby forms, in said second position on said rear side of said object to be wrapped, a first section which substantially conforms to said preselected length of said substantially web-like wrapping material, and a second section which has a length greater than said predetermined dimension of said object to be wrapped and contains an end section protruding past said object to be wrapped;

a support for the object to be wrapped conveyed into said second position;

said support being arranged, as seen in said predetermined conveying direction, forwardly of the web-like wrapping material held to extend under tension transversely relative to said predetermined conveying direction;

pressure means arranged above said support and defining together with said support a conveying channel for the object to be wrapped;

said pressure means acting upon the object passing through said conveying channel in order to compress said object and to bring said wrapping material into contact with the top surface of said object;

said protruding end section of said second section of the web-like wrapping material being placed towards and against said object to be wrapped during the movement of said object onto said support;

said object defining a further side which is contiguous to said rear side thereof;

means placing said protruding end section of said second section of the web-like wrapping material towards and against said further side of said object;

said object defining a bearing side constituting said further side which is contiguous to said rear side thereof;

said means placing said protruding end section of said second section of the web-like wrapping material towards and against said bearing side of said object to be wrapped;

said support comprising a conveyor means;

said conveyor means being arranged in said predetermined conveying direction forwardly of the web-like wrapping material held to extend under tension transversely relative to said predetermined conveying direction;

said support being displaceable between an upper and a lower position;

said conveyor means, in said upper position of said support, supporting said object to be wrapped in said second positions of said object to be wrapped;

retaining means for transiently retaining said object to be wrapped during the displacement of said support from said upper position to said lower position and vice versa;

said bearing side contiguous to said rear side of said object to be wrapped forming a bottom side thereof supported by said conveyor means in the upper position of said support; and said placing means comprising folding means for folding said protruding end section of said second section of the web-like wrapping material towards and against said bottom side of said object to be wrapped while the same is transiently retained in a position separated from said support and said support is transiently displaced from said upper position and separated from said object to be wrapped.

37. The apparatus as defined in claim 36, further including:

severing means to sever a loop of the web-like wrapping material;

second holding means for releasably holding the second section of the web-like wrapping material at the region of the free end thereof after the first section and the second section of the web-like wrapping material have been separated from each other by said severing means; and said second holding means being connected to said support.

38. The apparatus as defined in claim 36, wherein:

said retaining means comprise two retaining elements oppositely arranged relative to the object to be wrapped;

said retaining elements being displaceable between an inactive position and an active position; and said retaining elements in their active position transiently gripping the object to be wrapped at said bottom side of said object to be wrapped.

39. The apparatus as defined in claim 38, wherein:

said support, in said lower position thereof, and said object to be wrapped, when transiently retained at said bottom side of said object to be wrapped by said retaining elements in their active position, defining an intermediate space between said object and said support;

said folding means comprising at least one folding element; and said at least one folding element being moveable through said intermediate space and thereby entraining said protruding end section of said second section of the web-like wrapping material.

40. The apparatus as defined in claim 36, further including:

displacing means for transiently displacing said support from its upper position to its lower position and vice versa;

said displacing means containing drive means for displacing said folding means from a first position to a second position along said bottom side of said object to be wrapped in said second position of said object to be wrapped;

activating means for reversibly and transiently placing said retaining means into an active position for transiently retaining said object to be wrapped at its bottom side;

said support including said conveyor means being displaced by said displacing means into its lower position and said retaining means being transiently placed by said activating means into their active position and retaining said object to be wrapped on its bottom side, during the displacement of said folding means by said drive means from said first position to said second position whereby said protruding end section of said second section of the web-like wrapping material is folded towards and against said bottom side of said object to be wrapped; and said support, in said second position of said folding means, being returned into its upper position by said displacing means and supporting, by means of said conveyor means, said object to be wrapped on said bottom side of said object to be wrapped and to which part of said preselected length and said protruding end section of said wrapping material are applied.

41. The apparatus as defined in claim 36, wherein:

said conveyor means is a belt conveyor.

42. An apparatus for wrapping objects, especially quadrangular block-like objects, particularly packages formed by substantially flat products, for example, printed products, in a substantially web-like wrapping material, comprising:

conveying means for conveying an object which has a predetermined dimension and which is to be wrapped, in a predetermined conveying direction along a predetermined conveying path from a first position to a second position;

said object to be wrapped defining a rear side relative to said predetermined conveying direction;

a single storage roll holding a supply of said substantially web-like wrapping material and arranged on a first side of said predetermined conveying path;

a preselected length of said substantially web-like wrapping material extending, in the operative state of the apparatus and in said first position of said object to be wrapped on its front side relative to said predetermined conveying direction, from said first side of said predetermined conveying path and possessing a free end on a second side of said predetermined conveying path;

withdrawal means for withdrawing and guiding said substantially web-like wrapping material from said storage roll in order to extend transversely relative to said predetermined conveying path and to form a free end on said second side of said predetermined conveying path;

said withdrawal means being displaceable between an upper end position on said first side of said predetermined conveying path and a lower end position on said second side of said predetermined conveying path;

first holding means arranged on said second side of said predetermined conveying path and releasably holding said free end of said web-like wrapping material in said first position of said object to be wrapped;

said object to be wrapped, after being conveyed into said second position and after release of said free end of said substantially web-like wrapping material from said first holding means, being surrounded substantially in a U-shape on three sides by at least said preselected length of said substantially web-like wrapping material;

said withdrawal means in said upper end position and in said second position of said object to be wrapped being arranged above the substantially web-like wrapping material which extends from said single storage roll and surrounds said object on said three sides thereof;

said withdrawal means, during its displacement from said upper end position to said lower end position, withdrawing from said single storage roll said substantially web-like wrapping material which thereby forms, in said second position on said rear side of said object to be wrapped, a first section which substantially conforms to said preselected length of said substantially web-like wrapping material, and a second section which has a length greater than said predetermined dimension of said object to be wrapped and contains an end section protruding past said object to be wrapped;

displacing means for placing said protruding end section of said second section of the web-like wrapping material towards and against said object to be wrapped;

said object defining a further side which is contiguous to said rear side thereof;

said displacing means placing said protruding end section of said second section of the web-like wrapping material towards and against said further side of said object;

said object defining a bearing side constituting said further side which is contiguous to said rear side thereof;

said displacing means placing said protruding end section of said second section of the web-like wrapping material towards and against said bearing side of said object to be wrapped;

a support comprising a conveyor means;

said conveyor means being arranged in said predetermined conveying direction forwardly of the web-like wrapping material held to extend under tension transversely relative to said predetermined conveying direction;

said support being displaceable between an upper and a lower position;

said conveyor means, in said upper position of said support, supporting said object to be wrapped in said second position of said object to be wrapped;

retaining means for transiently retaining said object to be wrapped during the displacement of said support from said upper position to said lower position and vice versa;

said bearing side contiguous to said rear side of said object to be wrapped forming a bottom side thereof supported by said conveyor means in the upper position of said support;

said displacing means comprising folding means for folding said protruding end section of said second section of the web-like wrapping material towards and against said bottom side of said object to be wrapped while the same is transiently retained in a position separated from said support and said support is transiently displaced from said upper position and separated from said object to be wrapped.

43. The apparatus as defined in claim 42, further including:

severing means to sever a loop of the web-like wrapping material;

second holding means for releasably holding the second section of the web-like wrapping material at the region of the free end thereof after the first section and the second section of the web-like wrapping material have been separated from each other by said severing means; and said second holding means being connected to said support.

44. The apparatus as defined in claim 42, wherein:

said retaining means comprise two retaining elements oppositely arranged relative to the object to be wrapped;

said retaining elements being displaceable between an inactive position and an active position; and said retaining elements in their active position transiently gripping the object to be wrapped at said bottom side of said object to be wrapped.

45. The apparatus as defined in claim 44, wherein:

said support, in said lower position thereof, and said object to be wrapped, when transiently retained at said bottom side of said object to be wrapped by said retaining elements in their active position, defining an intermediate space between said object and said support;

said folding means comprising at least one folding element; and said at least one folding element being moveable through said intermediate space and thereby entraining said protruding end section of said second section of the web-like wrapping material.

* * * * *

UNITED STATES PATENT AND TRADEMARK OFFICE

CERTIFICATE OF CORRECTION

PATENT NO. : 4,738,078

DATED : April 19, 1988

INVENTOR(S) : Gottlieb Benz et al

It is certified that error appears in the above-identified patent and that said Letters Patent is hereby corrected as shown below:

Column 6, line 19, please delete "and" (second occurrence)

Column 11, line 55, please delete "defiend" and insert --defined--

Column 12, line 48, please delete "U-shaped" and insert --U-shape--

Column 13, line 19, please delete "against" and insert --again--

Column 15, line 26, please delete "inn-" and insert -- in- --

Signed and Sealed this

Twenty-second Day of November, 1988

*Attest:*

DONALD J. QUIGG

*Attesting Officer*

*Commissioner of Patents and Trademarks*